US010300620B2

(12) United States Patent
Ryan

(10) Patent No.: US 10,300,620 B2
(45) Date of Patent: May 28, 2019

(54) GROUND ANCHOR STRAP PULLER, TENSIONER AND CUTTER

(76) Inventor: Michael C. Ryan, Mitchellville, IA (US)

( * ) Notice: Subject to any disclaimer, the term of this patent is extended or adjusted under 35 U.S.C. 154(b) by 869 days.

(21) Appl. No.: 13/016,450

(22) Filed: Jan. 28, 2011

(65) Prior Publication Data

US 2012/0006166 A1 Jan. 12, 2012

Related U.S. Application Data

(60) Provisional application No. 61/299,257, filed on Apr. 28, 2010.

(51) Int. Cl.
*B26D 5/10* (2006.01)
*B26D 1/38* (2006.01)

(52) U.S. Cl.
CPC ..... *B26D 1/385* (2013.01); *B26D 5/10* (2013.01); *Y10T 83/727* (2015.04)

(58) Field of Classification Search
CPC ..... B65B 13/027; B65B 13/22; B65B 25/00; B21F 9/02; B25B 27/146
USPC ..... 269/55, 17; 52/DIG. 13, DIG. 11; 248/500, 505, 507, 510; 254/243, 500, 254/254, 245, 246, 251, 252, 253; 140/123.5; 83/597
See application file for complete search history.

(56) References Cited

U.S. PATENT DOCUMENTS

| | | | | | |
|---|---|---|---|---|---|
| 1,902,459 | A * | 3/1933 | Miller | 403/209 | |
| 3,161,149 | A * | 12/1964 | Monus | 410/116 | |
| 3,645,302 | A * | 2/1972 | Caveney | B65B 13/027 | 140/123.6 |
| 3,858,625 | A * | 1/1975 | Banjeglav | 140/123.6 | |
| 3,903,935 | A * | 9/1975 | Boothby | 140/124 | |
| 4,561,475 | A * | 12/1985 | Hinden | 140/123.5 | |
| 4,936,194 | A * | 6/1990 | Horowitz | 52/155 | |
| 5,775,037 | A * | 7/1998 | James | 52/163 | |
| 6,370,817 | B1 * | 4/2002 | Brooks et al. | 47/43 | |
| 7,175,367 | B2 * | 2/2007 | Hau | 405/184.3 | |
| 7,806,895 | B2 * | 10/2010 | Weier | A61B 17/823 | 140/93 A |
| 8,651,771 | B2 * | 2/2014 | Schneider et al. | 405/302.7 | |
| 2010/0178108 | A1 * | 7/2010 | Carpenter | 405/16 | |

* cited by examiner

*Primary Examiner* — Sean M Michalski
*Assistant Examiner* — Fernando A Ayala
(74) *Attorney, Agent, or Firm* — Prudens Law LLC

(57) ABSTRACT

A tool for advancing and tensioning a strap of an erosion control system through an aperture of a retaining washer to provide hold down pressure to an erosion control mat is described. The tool has a foot member that is positioned atop the retaining washer and serves to hold it in place during the installation operation. An upright support bar extends above the foot member and a slide tensioning subassembly is mounted for sliding movement on the support bar. A clamp is carried on the slide tensioning subassembly for releasably grasping the strap. A handle is mounted on the upright support bar for up and down sliding movement and interconnected to the slide tensioning subassembly and the clamp so that downward movement of the handle closes the clamp to grasp the strap and pull the slide member upwardly to advance the strap through the washer.

13 Claims, 15 Drawing Sheets

GROUND ANCHOR STRAP PULLER, TENSIONER AND CUTTER

This application claims priority to U.S. Patent Application Ser. No. 61/299,257, filed Jan. 28, 2010, which is incorporated herein in its entirety by this reference.

BACKGROUND OF THE INVENTION

This invention relates generally to anchoring erosion control mats and, more specifically, to a tool that pulls, tensions and cuts ground anchor straps to facilitate the installation of erosion control mats.

A method for controlling erosion that has developed recently is the use of erosion control mats, such as those sold under the mark ScourStop (Landmark Earth Solutions, Ankeny, Iowa). These mats are held in place by earth anchors with attached plastic straps. When installed, the straps extend up through the erosion control mats and engage with a plastic tension washer that has molded into it a metal clip retainer. The retainer pinches the strap and does not allow the strap to slide backwards after tension has been applied, thereby retaining the tension on the strap thereby applying hold down pressure on the retaining washer and anchoring the mat down atop the base underneath the mat. Existing installation requires an installer to manually pull on the strap to create tension in the strap, to slide the metal clip into place and then sever the extended tail of the strap. This is a cumbersome and time-consuming process and limits the amount of tension that can be created in the strap.

What is needed is a tool that will assist in proper and efficient installation of erosion control mats to automate the tensioning and cutting of the ground strap that is retained by the tension washer.

SUMMARY OF THE INVENTION

The present invention consists of a tool that pulls, tensions and cuts a strap used to hold in place erosion control mats. After an erosion control mat is placed on the surface where it is to be located, a ground anchor having a trailing plastic strap is inserted through a hole in the erosion control mat and pushed down into an anchoring position below the ground. The strap extends above the mat. The strap is passed through a retaining washer and the washer is pushed down the strap and onto the mat covering the hole through which the anchor was inserted. A retaining clip molded into the washer stops the strap from pulling back through the washer.

The tool has a generally upright body including an upright support bar and at the bottom of which is mounted a foot member that is situated atop a retaining washer. A vertical passage or slot is provided in one side of the foot member to allow the foot member to be placed about the strap. A clamp is mounted on a slide tensioning subassembly for reciprocal vertical movement between a release position adjacent the foot member and a continuum of tensioning positions displaced above the foot member. The clamp is moveable between an open position and a closed position releasably grasping the strap. A handle is pushed downwardly to cause the clamp first to grasp the strap at a low position and further downward movement of the handle pulls the slide tensioning subassembly upwardly to advance the strap through the retaining washer as the clamp is raised to a tensioning position. The handle pulled back upwardly by spring tension induced during the downward movement which causes the jaws to release the strap and return to the released or starting position. Multiple pumps of the handle may be required to advance a sufficient amount of the strap through the retainer washer and put sufficient tension on the strap. When the strap is properly tensioned, the handle is released and moved upwardly by spring tension to release the strap. A cutter is provided and extends horizontally inside the foot member and is actuated by a downward push on a cutter handle near the top of the tool to sever the strap adjacent the foot member leaving an acceptably short tail of the strap extended above the retaining washer.

An object of the invention is to hold down the retaining washer with its embedded metal retaining clip that secures the ground strap while pulling and tensioning the strap.

Another object of the invention is to allow an installer to stand in the upright position while installing the erosion control mat.

A further object of the invention is to automate tensioning of the ground strap to the required tension.

Yet another object of the invention is to automate cutting of the ground strap after the ground strap has been tensioned.

Yet a further object of the invention is allow the tensioning device to be either slid sideways across the strap and retaining washer or down over the top of the strap and up thru the eccentric clamping jaw and slide tensioning mechanism.

DETAILED DESCRIPTION OF PREFERRED EMBODIMENTS

Figure 7:
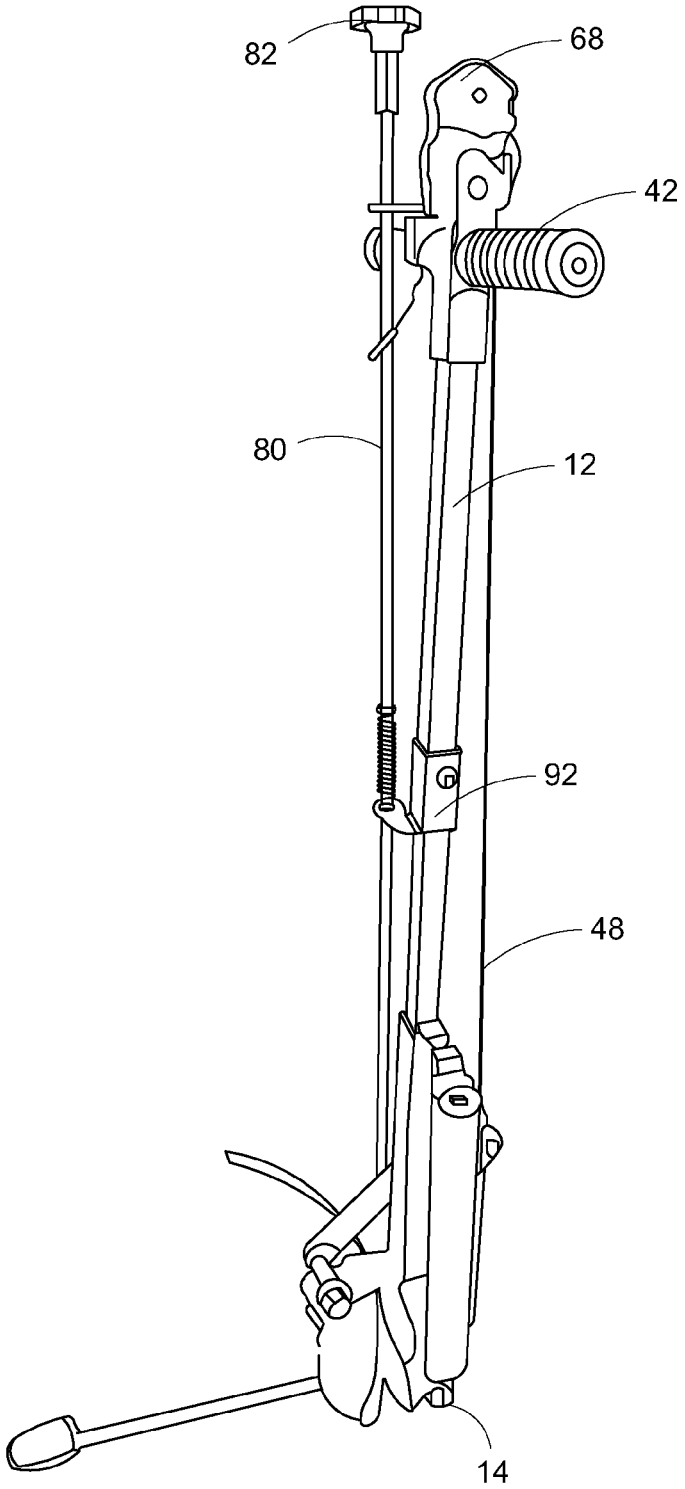
FIG. 7 is a perspective view of a preferred embodiment of the present invention.
Figure 14:
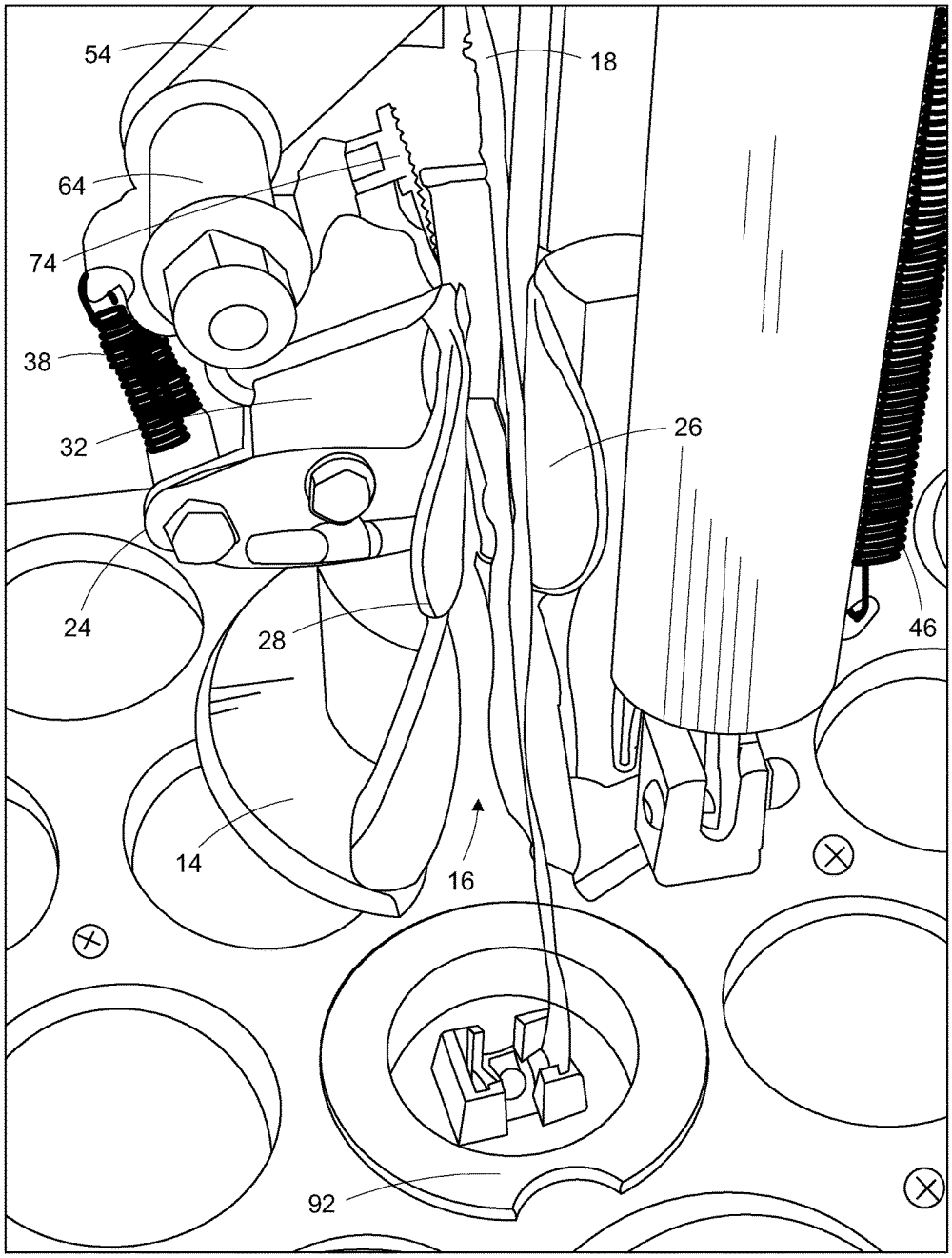
FIG. 14 is an enlarged side view of the lower end of the embodiment of FIG. 7 showing the tool being moved into position above a retaining washer of an erosion control mat aligning the strap with the passageway providing access to the working area of the tool.

Referring to FIG. 7, there is illustrated generally at 10 a tool that is a preferred embodiment of the present invention. The tool 10 includes an upright support bar 12 at the bottom of which is mounted a foot member 14 on which the tool 10 is supported during use. The foot member 14 is provided with a passage 16 which in use accepts a strap 18 (FIG. 14) of a ground anchor of an erosion control system.

Figure 12:
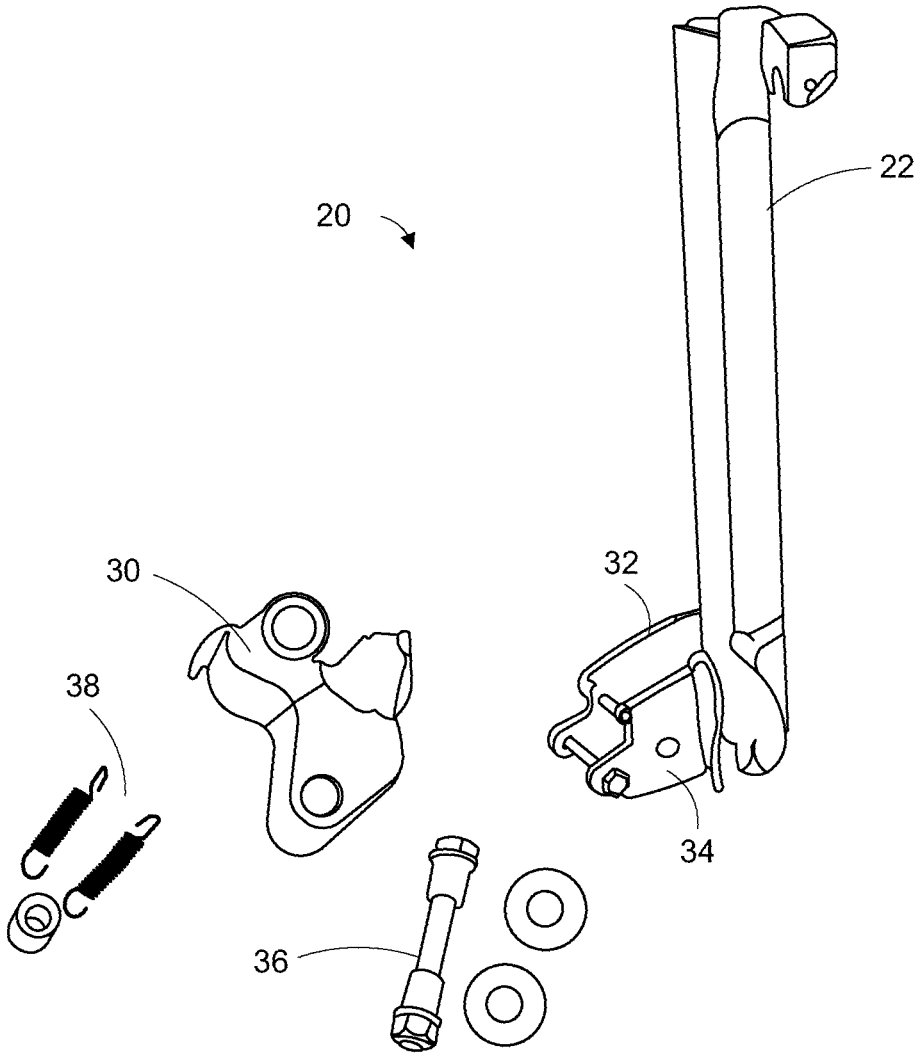
FIG. 12 is an exploded view of a slide tensioning subassembly.

A slide tensioning subassembly 20 (FIGS. 12 and 13) has an upright tube 22 that receives the upright support bar 12 for relative sliding movement therebetween. The slide tensioning subassembly 20 includes an eccentric clamp 24 that can releasably engage and grasp the strap 18. Access of the strap 18 to the clamp 24 is provided through a pair of ears 26 and 28. The clamp 24 is moved into and out of engagement with the strap 18 by an eccentric cam 30 that is mounted for pivotal movement between a pair of mounting flanges 32 and 34 of the slide tensioning subassembly 20 by a shaft bearing 36. A pair of springs 38 bias the eccentric cam 30 away from engagement with the strap 18.

Figure 9:
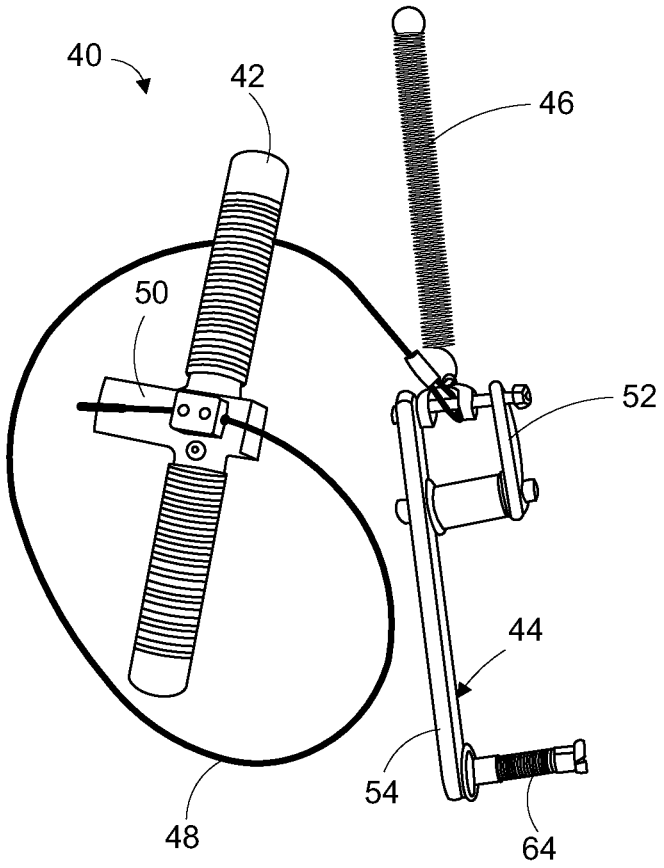
FIG. 9 is a view of a handle, cable, spring and clamp engagement arm subassembly.
Figure 10:
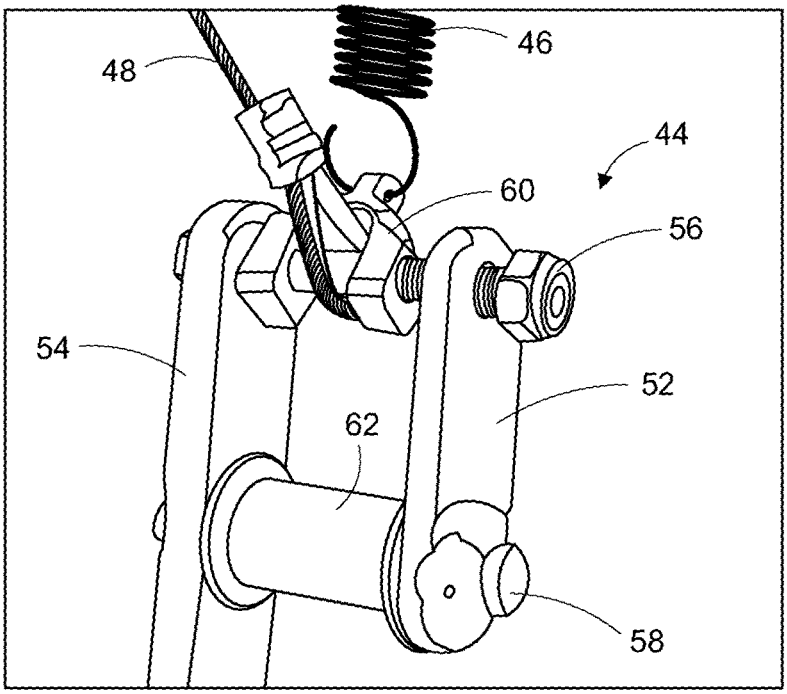
FIG. 10 is an enlarged view of where the cable attaches to the clamp engagement arm.
Figure 13:
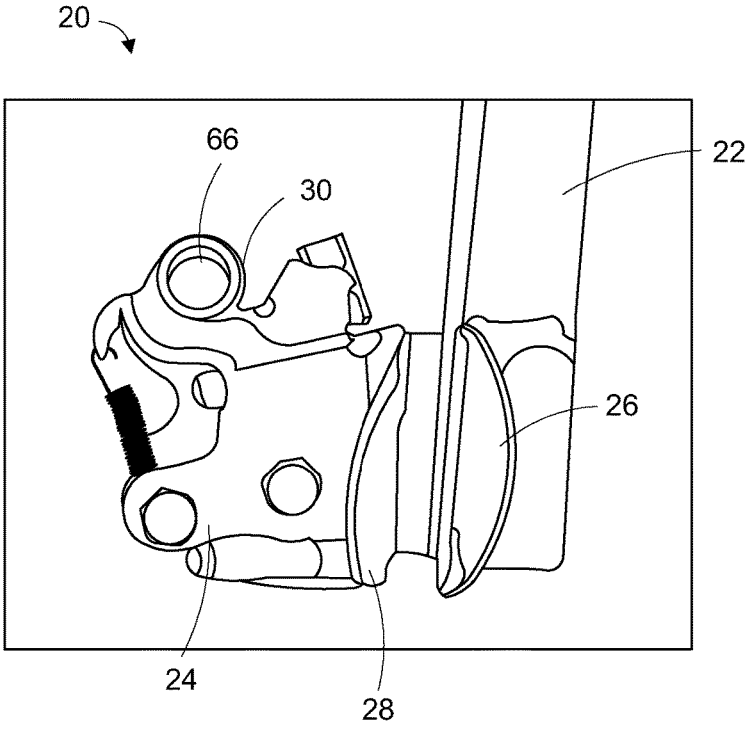
FIG. 13 is an enlarged side view of the lower end of the slide tensioning subassembly.

The eccentric clamp 24 is moved to the closed position by a clamp torque subassembly 40 (FIGS. 9 and 10). Included is a handle 42, a clamp torque arm mechanism 44, spring 46 and a cable 48 interconnecting the handle 42 and the clamp torque arm mechanism 44. The handle 42 has centrally mounted tube section 50 that is received about the upright support bar 12 for sliding movement of the handle 42 up and down the support bar 12. The clamp torque arm mechanism 44 has a pair of parallel bars, short bar 52 and long bar 54 that are held in a spaced-apart relation by a pair of bolts 56 and 58. Bolt 56 supports a clevis 60 to which an end of the spring 46 is attached and is also the attachment member for an end of the cable 48. Bolt 58 carries a thrust roller 62. Extended transversely inwardly of the free end of the long bar 54 is a shaft 64 that will be received in a corresponding hole 66 of the eccentric cam 30 (FIG. 13). Bolts 56 and 58 are spaced apart so that the clamp torque arm mechanism can slide up and down on the upright support bar 12 between the handle 42 and the slide tensioning subassembly 20 with the thrust roller 62 riding on the front surface of the upright support arm 12.

Figure 1:
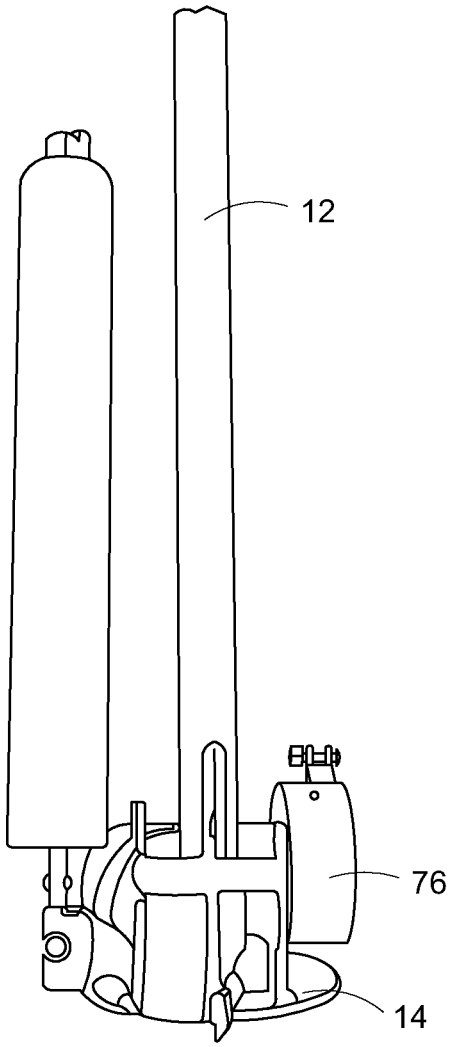
FIG. 1 is rear view of a foot member of a preferred embodiment of the present invention.
Figure 2:
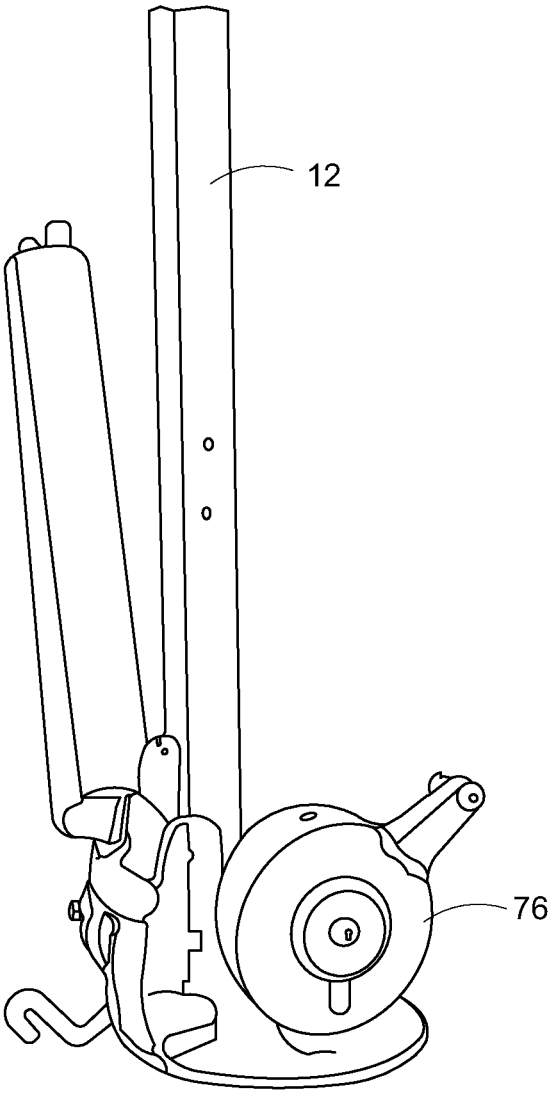
FIG. 2 is a first side view corresponding to FIG. 1.
Figure 3:
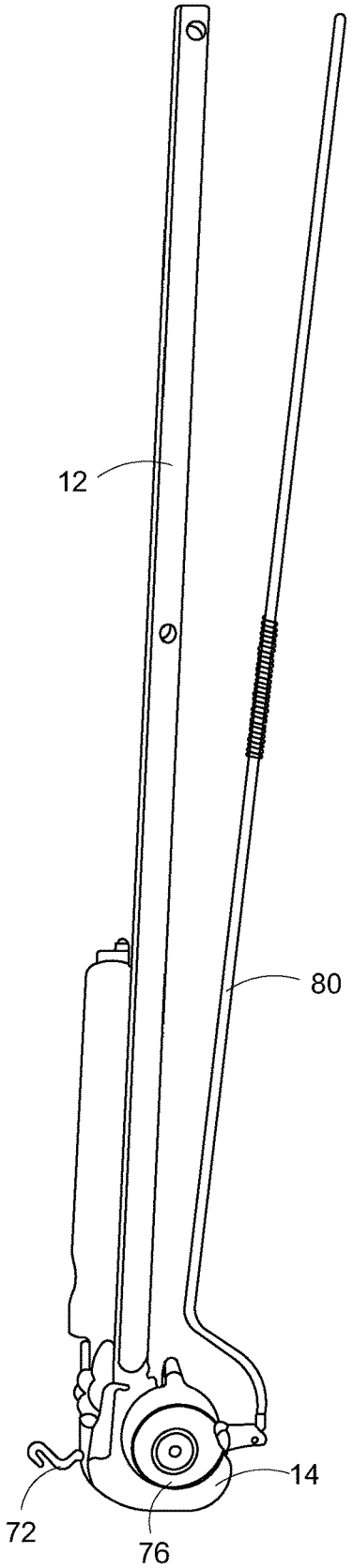
FIG. 3 is an opposite side view corresponding to FIG. 1 and showing a push rod for activating the rotary knife.
Figure 4:
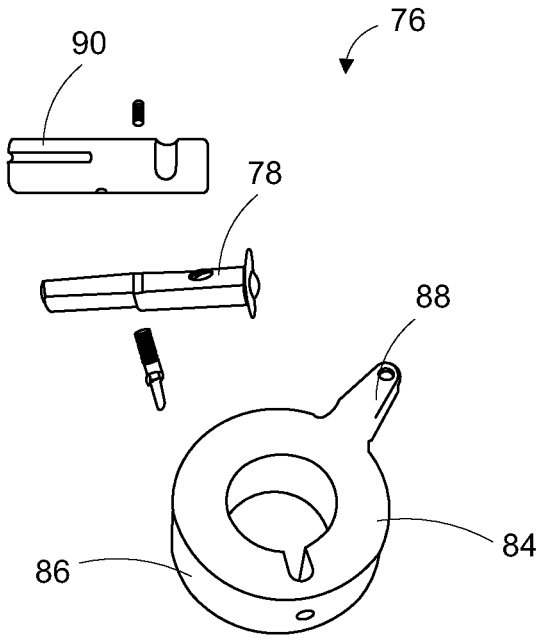
FIG. 4 is an exploded view of the components of the rotary knife.
Figure 5:
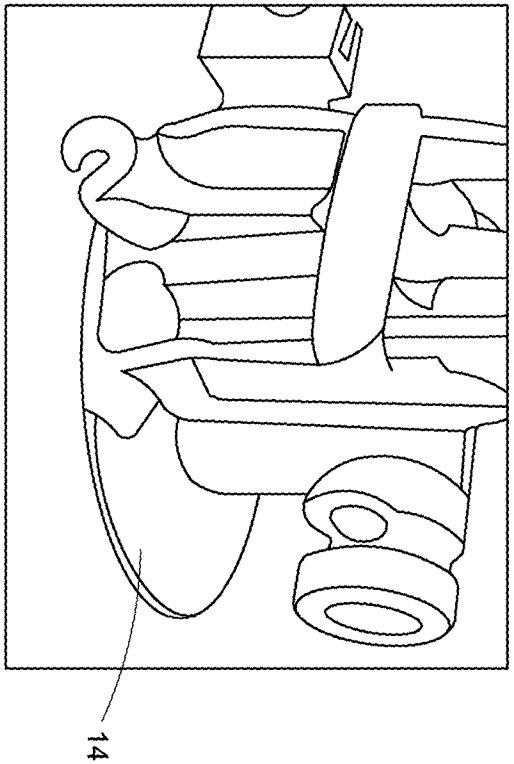
FIG. 5 is a rear perspective view of the foot member with the rotary knife disassembled.
Figure 8:
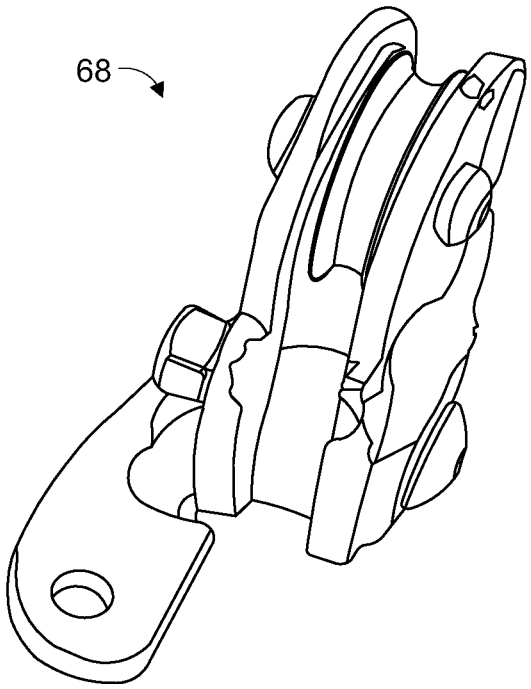
FIG. 8 is a perspective view of a cable pulley.
Figure 11:
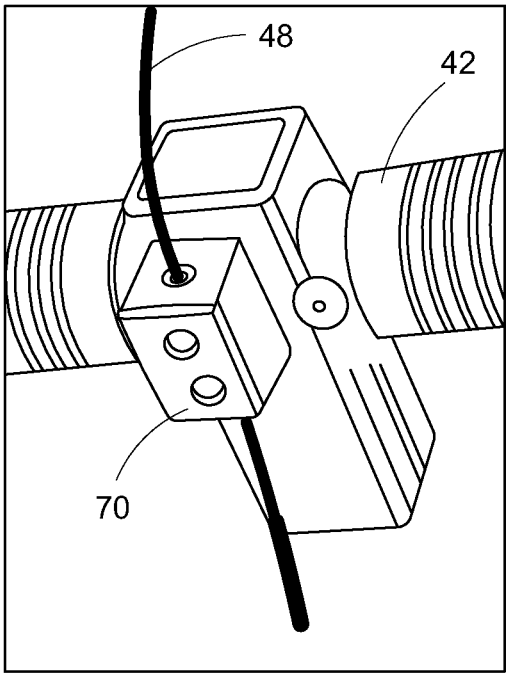
FIG. 11 is an enlarged view of the handle showing a cable tension adjustment block.

A cable pulley 68 (FIG. 8) is mounted centrally on the upper end of the upright support arm 12 and has a diameter larger than the front-to-back dimension of the upright support bar 12. Cable 48 passes over the cable pulley 68, thus extending from a cable tension block 70 (FIG. 11) mounted on the handle 42 and positioned in front of the upright support bar 12, over the cable pulley 68, and down the back side of the upright support bar 12 to the clamp torque arm mechanism 44. Accordingly, downward sliding movement of the handle 42 on the upright support arm 12 will cause the cable 48 to pull upwardly on the clamp torque arm mechanism 44. Spring 46 extends from the clamp torque arm mechanism 44 down to a mounting arm 72 (FIGS. 2 and 3) on the foot member 14 and so resists upward movement of the clamp torque arm mechanism 44.

Figure 15:
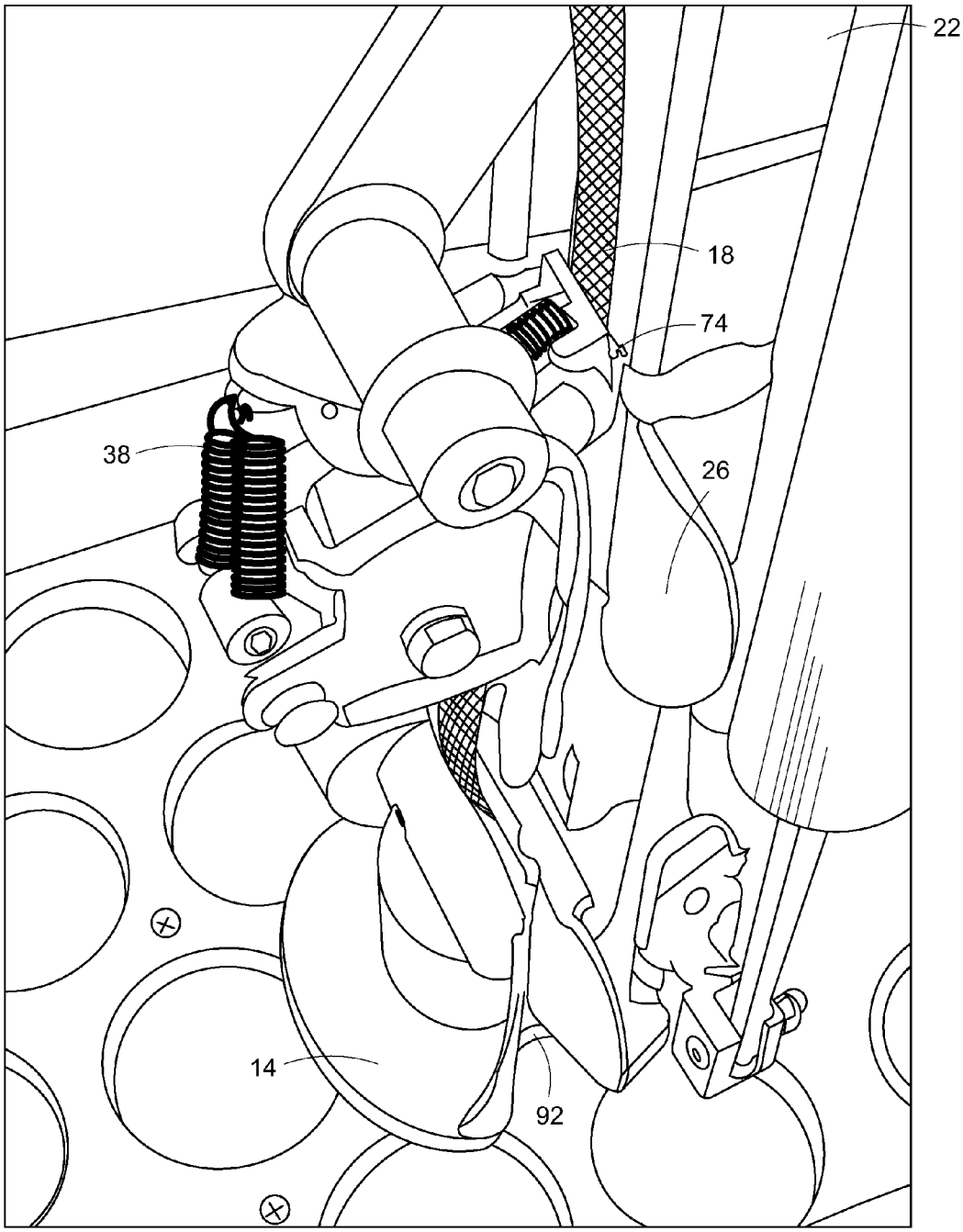
FIG. 15 is an enlarged view corresponding to FIG. 14 showing the clamp engaging and advancing the strap and showing the strap inside the rotary knife.

Upward pressure on the clamp torque arm mechanism 44, resulting when an operator pushes downwardly on the handle 42, forces the thrust roller 62 to engage the upright support arm 12 and causes the clamp torque arm mechanism 44 to tilt downwardly at the front of the tool 10, causing the clamp torque arm mechanism 44 to move toward the front side of the slide tensioning subassembly 20. Since the shaft 64 is thus moved inwardly, it will overcome the opening bias provided by the springs 38 to pivot the eccentric cam 30 toward the closed or clamping position, resulting in the clamp 24 closing and grasping the strap 18. Further downward movement of the handle 42 will now raise the slide tensioning subassembly 20 upwardly on the upright support bar 12 (FIG. 15). Since the strap 18 is firmly grasped in the clamp 24, which in turn is supported on the slide tensioning assembly 20, the strap 18 is advanced through the retaining washer 92 as desired.

Actuation of the tool 10 by downward pressure on the handle 42 has several advantages. Downward pressure on the handle 42 applies downward pressure on the retaining washer and the affected area of the erosion control mat thereby helping to assure that the washer and mat stay in their desired positions. Additionally, downward pressure on the handle 42 applies force to the eccentric cam 30 to engage, hold and grip the ground strap 18. The more downward pressure that is applied to the handle 42, the more downward pressure that is applied to the eccentric cam 30 and clamp 24 by the clamp torque arm mechanism 44. Therefore the original downward force is translated not only into down pressure on the retaining washer and mat but also at the same time is translated into rotational clamping force applied to the strap 18 positioned in the slide tensioning member 20 by the pivoting eccentric cam 30.

In a preferred embodiment, the eccentric cam 30 may be provided with a strap engagement plate 74 (FIG. 14) which a sharp textured surface to act to provide more clamping pressure and more positive surface contact with the strap 18. The engagement plate 74 is designed at an angle such that the top front portion of its textured surface makes first contact with the strap 18 as it is rotated into the clamping position. This design feature forces this textured engagement plate 74 to rotate such that as it makes full contact with the surface of the strap 18 as it is drawn down into a tighter clamping position as the strap 18 starts to be tensioned and cause the eccentric cam 30 to be drawn into tighter and tighter rotational contact with the strap 18 in the slide tensioning subassembly 20. As more down pressure is applied to the slide handle 42 and the eccentric cam 30 has reached its maximum clamping position, the slide tensioning subassembly 20 starts to be pulled upwardly by the cable 48 with the ground strap 18 securely clamped in the eccentric cam 30 on its way to being properly tensioned. The back pressure of the ground strap 18 also compounds the clamping force of the eccentric cam 30 and engagement plate 74.

In use of the tool 10, the ground strap 18 is securely captured in the eccentric cam 30 of the slide tensioning subassembly 20 is then pulled upward by the slide tensioning subassembly 20 which is being pulled up by the cable 48 which is affixed to the rear torque arm pivot or bolt 56 of the clamp torque arm mechanism 44. The cable 48 is being pulled up by the down pressure being applied to the slide handle 42 being forced down by the operator in that the cable 48 traveling over top of the pulley 68 is affixed to the front of the slide handle 42 in the cable adjustment block 70. This down pressure being applied by the operator not only pulls the strap 18 up but at the same time holds down on the tension washer in place below the tool 10 in engagement with the erosion control mat. This hold down pressure allows for the ground strap 18 to be easily drawn up through the retaining clip without the operator being required to hold the retaining washer in place with a slotted piece of metal and the operator's foot.

The cable tension adjustment block 70 allows the cable 48 to slide through the handle slide 42 while at the same time loading the spring 46 of the slide tensioning subassembly 20 and the springs 38 of the clamp 24. When the desired preload (down stroke time it takes to start rotating the eccentric cam 30 after applying down pressure to the slide handle 42) has been achieved the operator can lock the cable 48 into place in the clamping block 70 of the slide handle 42 thereby capturing the preload.

It will be learned quickly by those skilled in the art on the first tensioning stroke of the strap 48 that the necessary pull length of the strap 18 to achieve the required hold down pressure on the erosion control mat or the required tension on the ground strap 18 might require a second or third, or more tensioning stroke of the ground strap 18. It was therefore found to be necessary to provide a back pressure mechanism 76 for the slide tensioning subassembly 20. The back pressure mechanism 76 for the preferred embodiment is a storm door closure (FIGS. 1-3, 7 and 14). The back pressure mechanism 76 temporarily holds the slide tensioning subassembly 20 in the up position and slowly allows the slide tensioning subassembly 20 to lower into its lower or reset position. This hold back action to the slide tensioning subassembly 20 the necessary offset to allow the tension spring 46 that is attached to the rear of the torque arms 44 by a swivel clevis 60 and directly below the tensioning cable 48 to pull down on the torque arms 44 thereby forcing open the eccentric cam 30, with the assist of the tension springs 38 attached to the top back of the eccentric cam 30, allowing the engagement plate 74 to free itself from the ground strap 18 and allow the slide tensioning subassembly 20 to return to its down or reset position while allowing the ground strap 18 to pass freely through the slide tensioning subassembly 20 thereby automatically resetting the slide tensioning subassembly 20 for another tensioning stroke. The accumulated length of the tensioning stroke achieved on the ground strap 18 is maintained by the metal clip washer in the retaining washer.

When the slide tensioning subassembly 20 has been lowered to the bottom of its stroke, the operator is able to again repeat the process to tension the ground strap 18 to the desired or required hold down tension without any required repositioning of the tool 10.

Note that there are many ways to determine or indicate when the desired or required tension has been achieved, whether mechanical, electrical, hydraulic or any combination thereof that economically yields the desired result. Examples of such include: A compound spring attached to the tensioning cable 48 or any tensioning member that would pull the inner spring out when the required tension has been achieved; a digital strain sensor that would act like a spring scale with a read out; an adjustable dial-faced mechanical spring scale to indicate the required tension; and an adjustable/re-settable hydraulic pressure relief valve.

Another important feature of the current invention is the ability of the installer to automatically cut the ground strap 18 off close to the hold down tensioning washer at the completion of the tensioning cycle without the necessity of repositioning the tool 10, without requiring any additional tools, without the use of the operator's feet or a slotted plate, and all while standing in the upright position.

Figure 6:
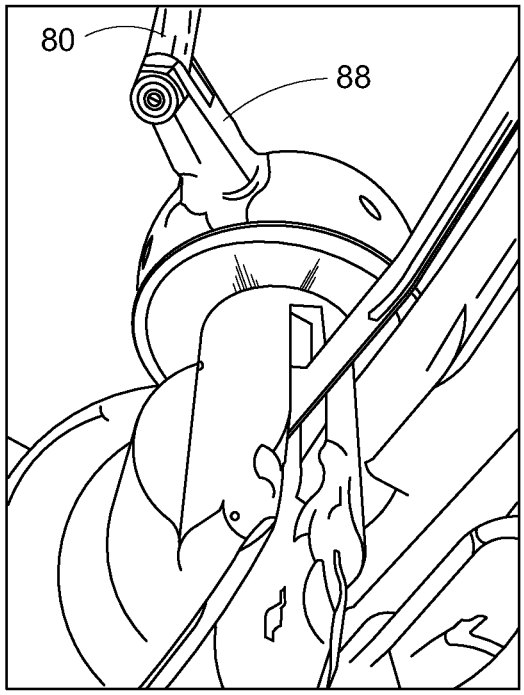
FIG. 6 is an upper perspective view of the foot member and rotary knife showing a strap of an erosion control mat system extended through the rotary knife.

A rotary cutting blade and its associated cutting sleeve 76 (FIGS. 1-6) are positioned horizontally in the foot member 14, so that the knife 78 is directly underneath the slide tensioning subassembly 20 and with the ground strap slot or passage 16 aligned such that the ground strap 18 will pass through the cutter assembly 76 (FIG. 6) and into position in the slide tensioning subassembly 20 to interface with the eccentric clamp 24. The ground strap 18 is fed up through the cutter assembly 76 from the bottom or slid into position in the cutting slot 16 from the side as the tool 10 is positioned for the tensioning cycle. The strap 18 remains in and is fed up through the rotary cutter assembly 76 as it, is tensioned.

When the required tension of the ground strap 18 is achieved the rotary cutting knife 78 is rotated through the cutting action of the ground strap 18 by downward pressure applied by the operator on an upward protruding shaft member 80 that extends up the length of the tool 10 to an area in front of and even with the slide handle 42. This seems to be a convenient placement for this action as this action is performed after the required tensioning of the ground strap has been achieved. A hand knob 82 is affixed to the end of the cutter rod 80 so that the operator can force down on the shaft 80 to apply rotational torque to the cutting knife 76 through an external rotating sleeve 84 that has an internal slot 86 machined in it to accept a perpendicular drive shaft 78 that is threaded into the cylindrical cutter knife 76.

The downward pressure on the shaft 80 applies rotational torque to the external rotating drive sleeve 84 that the push rod is attached to by a short clevis 88. The rotational torque action of this sleeve 84 that is attached to and driven by the push rod 80 is returned to its set position by a compression 90 spring mounted so as to allow the drive shaft 78 to pass through its center as it is being pushed down. The drive shaft has a hole drilled just above the top of the spring 90 and nylon bushing for a cotter pin keeper to be placed to provide compressive upward force on the drive shaft 78 to return it to its set (open) position after having been pushed through its cutting action.

Another option apparent after using this original design is one where two tension cables are ran down each corner of the front side of the upright support bar 24 and the cable tensioning adjustment block 70 is placed on the back side of the slide handle 42 and two cable pulleys or such are placed on the sides of the top of the upright support bar 24. The cable 48 would run down to the two pulleys and would terminate at the top pivot pin 64 of the eccentric cam 30. This would replace both the torque arms 44 and the torque arm tension spring 46 that is attached to the rear of the torque arms 44.

A lever arm design was also considered instead of the slide handle mechanism but was found to be more difficult to position originally over the retaining washer and maintain that position as the tensioning action proceeded.

It should be noted also that if the strap tensioning requirements exceed the available output torque of a single pulley system, a cable pulley can be added to the end of the torque arm assembly 44 where the cable 48 now terminates and make the cable termination point the slide stop 92 in the center portion of the upright support bar 24. This would apply an increased mechanical advantage to the tensioning of the strap.

The importance of this invention in conjunction with the erosion control mats and as it pertains to the long term performance of the mats is significant. If the required hold down tension of the ground straps 18 in relation to the mats is not somehow automatically assured to be performed by the installers at the time of the mats original installation, the expected performance and longevity of the mats and their designed functionality cannot be executed or guaranteed.

While the invention has been described as providing a down force, it could of course also be used overhead to grasp a strap or similar structure and provide a lifting force. Additionally, while the invention has been described with respect to an embodiment pulling on a ground anchor strap, the feature of using a downward force to result in an upward movement could be advantageously used in a wide variety of applications. The important feature is the use of a downward force on a handle to pull an embedded member toward the handle. For example, a larger stronger embodiment of the invention could be used for removing fence posts from the ground. Those skilled in the art could modify the preferred embodiment to remove nails. Additional pulling force could be created by having a machine move the handle, such as by the application of a hydraulic cylinder or the like.

The foregoing description and drawings comprise illustrative embodiments of the present inventions. The foregoing embodiments and the methods described herein may vary based on the ability, experience, and preference of those skilled in the art. Merely listing the steps of the method in a certain order does not constitute any limitation on the order of the steps of the method. The foregoing description and drawings merely explain and illustrate the invention, and the invention is not limited thereto, except insofar as the claims are so limited. Those skilled in the art that have the disclosure before them will be able to make modifications and variations therein without departing from the scope of the invention.

I claim:

1. A tool for advancing a strap through an aperture, comprising:

(a) a foot positioned atop the aperture, the foot having a passage that accepts a strap;

(b) a support bar extending substantially perpendicular to the foot such that the support bar is extended vertically above the foot;

(c) a slide member having an upright tube that receives the support bar and mounted for sliding movement on the support bar;

(d) a clamp carried on the slide member for releasably grasping the strap; and (e) a handle having a tube section that receives the support bar and interconnected to the slide member and the clamp and moveable downwardly to close the clamp to grasp the strap and pull the slide member upwardly to advance the strap through the aperture while maintaining downward pressure on the foot.

2. A tool as defined in claim 1, further comprising a knife operable to sever the strap after it has been advanced.

3. A tool as defined in claim 1, wherein the handle is interconnected to the slide member by an apparatus comprising a cable.

4. A tool as defined in claim 1, wherein the handle is interconnected to the slide member by an apparatus comprising a pivot member.

5. A tool as defined in claim 4, wherein the pivot member is interconnected to the clamp and downward movement of the handle pivots the pivot member to close the clamp.

6. A tool as defined in claim 1, further comprising a passage in the side of the foot providing access of the strap to the clamp.

7. A tool for advancing and tensioning a strap of an erosion control system through an aperture of a retaining washer to provide hold down pressure to an erosion control mat, comprising:

(a) a foot member positioned atop the retaining washer, the foot member having a passage that accepts a strap;

(b) an upright support bar extending substantially perpendicular to the foot member such that the support bar is extended vertically above the foot member;

(c) a slide tensioning subassembly having an upright tube that receives the support bar and mounted for sliding movement on the support bar;

(d) a clamp carried on the slide tensioning subassembly for releasably grasping the strap; and (e) a handle having a tube section that receives the support bar for up and down sliding movement and interconnected to the slide tensioning subassembly and the clamp and moveable downwardly to close the clamp to grasp the strap and pull the slide member upwardly to advance the strap through the washer while maintaining downward pressure on the foot member.

8. A tool as defined in claim 7, further comprising a knife operable to sever the strap after it has been advanced.

9. A tool as defined in claim 7, wherein the handle is interconnected to the slide tensioning subassembly by an apparatus comprising a cable.

10. A tool as defined in claim 7, wherein the handle is interconnected to the slide tensioning subassembly by an apparatus comprising a torque arm assembly.

11. A tool as defined in claim 10, wherein the torque arm assembly is interconnected to the clamp and downward movement of the handle pivots the torque arm assembly to close the clamp.

12. A tool as defined in claim 7, further comprising a passage in the side of the foot member providing access of the strap to the clamp.

13. A tool for pulling on an embedded member, comprising:

(a) a foot positioned about the embedded member;

(b) a support bar extending substantially perpendicular to the foot such that the support bar is extended vertically from the foot;

(c) a slide member mounted for sliding movement on the support bar;

(d) a clamp carried on the slide member for releasably grasping the embedded member; and (e) a handle interconnected to the slide member and the clamp and moveable downwardly to close the clamp to grasp the embedded member and pull the slide member upwardly to pull the embedded member toward the handle.

* * * * *